US010400406B2

(12) United States Patent
O'Sullivan et al.

(10) Patent No.: US 10,400,406 B2
(45) Date of Patent: Sep. 3, 2019

(54) WAVE DISSIPATION SYSTEMS, MODULES AND METHODS FOR CONSTRUCTING THE SAME

(71) Applicants: Manson Construction Co., Jacksonville, FL (US); COWI Marine North America, Trumbull, CT (US)

(72) Inventors: Michael J. O'Sullivan, Oakland, CA (US); John A. Holmes, Seattle, WA (US)

(73) Assignee: COWI MARINE NORTH AMERICA, Trumbull, CT (US)

( * ) Notice: Subject to any disclaimer, the term of this patent is extended or adjusted under 35 U.S.C. 154(b) by 0 days.

(21) Appl. No.: 15/591,907

(22) Filed: May 10, 2017

(65) Prior Publication Data

US 2017/0342673 A1 Nov. 30, 2017

Related U.S. Application Data

(60) Provisional application No. 62/334,088, filed on May 10, 2016.

(51) Int. Cl.
*E02B 3/06* (2006.01)

(52) U.S. Cl.
CPC ..... *E02B 3/06* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 810,630 | A * | 1/1906 | Dwight | E02B 3/06 | 405/31 |
| 954,283 | A * | 4/1910 | Hawkes | E02B 3/06 | 405/21 |
| 1,610,341 | A * | 12/1926 | Wells | E02B 3/06 | 405/21 |
| 3,280,569 | A * | 10/1966 | Wosenitz | E02B 3/06 | 405/34 |
| 3,875,750 | A | 4/1975 | Campbell | | |
| 4,297,052 | A * | 10/1981 | Rankin | E02B 3/14 | 405/16 |
| 4,407,608 | A | 10/1983 | Hubbard | | |
| 4,498,805 | A | 2/1985 | Weir | | |

(Continued)

FOREIGN PATENT DOCUMENTS

| | | | | |
|---|---|---|---|---|
| DE | 3406752 A1 * | 9/1985 | ..... | E02B 3/14 |
| FR | 2030614 A5 * | 11/1970 | ..... | E02B 3/06 |
| FR | 2476712 A1 * | 8/1981 | ..... | E02B 3/06 |

*Primary Examiner* — Kyle Armstrong
(74) *Attorney, Agent, or Firm* — McCarter & English, LLP; David J. Silvia

(57) ABSTRACT

Disclosed are wave dissipation systems, modular units for use in wave dissipation systems and methods of constructing the same. Embodiments of the present disclosure are directed to the construction of breakwater systems using a plurality of modular elements which can be interlocked to form an elongated breakwall. Each module unit includes a base unit and a lid element. The base unit has a bottom wall, a rear wall, laterally opposed side walls and a front wall which in combination define an energy dissipation chamber. The lid element covers the energy dissipation chamber of the base unit and is disposed on top of the base unit at angle with respect to the bottom wall.

19 Claims, 14 Drawing Sheets

(56) References Cited

U.S. PATENT DOCUMENTS

| | | | | | |
|---|---|---|---|---|---|
| 4,502,816 | A | * | 3/1985 | Creter, Jr. | E02B 3/06 405/30 |
| 4,722,598 | A | | 2/1988 | Ford | |
| 4,776,725 | A | | 10/1988 | Brade | |
| 4,801,221 | A | | 1/1989 | Capron | |
| 4,896,996 | A | | 1/1990 | Mouton et al. | |
| 5,011,328 | A | | 4/1991 | Atkinson et al. | |
| 5,087,150 | A | * | 2/1992 | McCreary | E02B 3/06 405/31 |
| 5,120,156 | A | | 6/1992 | Rauch | |
| 5,129,756 | A | | 7/1992 | Wheeler | |
| 5,238,326 | A | | 8/1993 | Creter | |

* cited by examiner

WAVE DISSIPATION SYSTEMS, MODULES AND METHODS FOR CONSTRUCTING THE SAME

CROSS-REFERENCE TO RELATED APPLICATIONS

The present application claims priority to U.S. Provisional Application No. 62/334,088, filed on May 10, 2016, entitled Wave Dissipation Systems, Modules and Methods for Constructing the Same. The contents of this application are incorporated by reference in its entirety.

BACKGROUND OF THE INVENTION

1. Field of the Invention

The subject disclosure relates to wave dissipation systems, modular units for use in wave dissipation systems and methods of constructing the same, and more particularly to the construction of breakwater systems using a plurality of modular elements, and still more particularly to a breakwater system which in certain embodiments includes interlocking precast, preformed and reinforced elements.

2. Background of the Related Art

Beaches experience erosion in response to energy resulting from waves that impinge on the shoreline. A variety of breakwater systems and designs have been previously used with varying degrees of success, to inhibit the deterioration of beaches. Many of the previous breakwater systems have been constructed in areas having relatively low tidal ranges. In regions where tidal ranges exceed one meter, the stage of the tide also plays an important role on the vertical distribution of wave energy on the beach face.

In regions of relatively high tidal range, low-profile modules are often ineffective. If the devices are placed on the upper part of the beachface to shield the shore from waves at high water, the devices are left high-and-dry as the tide falls to low water level. If they are placed to intercept waves at low water, then they are too deep at high water to effectively shield the beach from incoming waves.

Since beaches are made of granular material, they are subject to change in direct response to the ability of the wind, waves and currents to transport the sediment. The process of erosion is an accounting problem related to sand transport by wind, waves and currents. Simply stated, when more beach material leaves a section of shore than it receives, the volume loss is described as erosion. When more beach material enters a section of shore than it loses, the volume gain is described as accretion. Since the capacity of a wave to transport sand is related to its size, then variations in wave size similarly relate to variations in the transport capacities of wave fields. Large waves, or strong wave-driven currents, have a greater capacity to transport beach material than small waves or weak wave-driven currents. By obstructing a portion of an incoming wave field, the capacity of the wave field to transport sediment is also diminished. The resultant is that less sand is removed from the beach than would be expected from the previously unobstructed waves. This is the main principal in the use of breakwaters for inhibiting erosion.

U.S. Pat. Nos. 3,875,750; 4,407,608; 4,498,805; 4,722,598; 4,776,725; 4,801,221; 4,896,996; 5,011,328; 5,120,156; 5,129,756; and 5,238,326 represent an evolution of concepts that have provided partial solutions to some coastal areas of the world. Although some of these systems have provided valuable insights to the art, none have proven to be universally successful.

Some of the prior art has been directed toward trapping the littoral transport system. Others have been located further offshore to intercept wave energy before it reaches the shore. Much of the offshore systems have been composed of relatively small modules that are placed side-by-side and stacked to produce a submerged barrier parallel to the shoreline. Scour at the base of individual modules often causes them to shift, rotate forward, and/or sink into the seafloor. Stacks of multiple modules are massive, tend to sink into the seafloor rapidly and are difficult to remove or re-orient for breakwater modification or upgrade.

Despite these prior are systems and designs, there is still a need for an economical breakwater design and installation method which is long lasting and reusable. Moreover, it is further advantages to provide a modular unit for use in a breakwater system which can be made from precast concrete and formed remotely and later placed at the beach site. Still further, there is still a need for a rapidly constructible breakwater system which is adaptable to a variety of beach erosion problems and can address sea-level rise conditions.

SUMMARY OF THE INVENTION

As will be discussed in greater detail below in the Detailed Description section of this disclosure, the present invention is directed to wave dissipation systems, modular units for use in wave dissipation systems and methods of constructing the same. More particularly, embodiments of the present disclosure are directed to the construction of breakwater systems using a plurality of modular elements. It is envisioned that each module unit includes a base unit and a lid element. The base unit has a bottom wall, a rear wall, laterally opposed side walls and a front wall which in combination define an energy dissipation chamber. The lid element covers the energy dissipation chamber of the base unit and is disposed on top of the base unit at angle with respect to the bottom wall. It is envisioned that the base and lid units can be manufactured as separate items or formed together as a unitary structure. The use of a two-piece construction is simply for convenience of fabrication and assembly. Those skilled in the art will readily appreciate that each of the units could be formed from several parts rather than as a single part.

It is envisioned that the front wall of the base unit can include a stop flange for supporting a front end of the lid element. In certain constructions, the stop flange includes a J-shaped recess which receives the front end of the lid element.

Preferably, a plurality of laterally extending v-shaped grooves are formed on a lower surface of the bottom wall. The bottom wall can also include a plurality of apertures which extend from the energy dissipation chamber and through the bottom wall. In certain preferred constructions, the apertures in the bottom wall are tapered and have a larger diameter at the bottom than at the top of the aperture. Additionally, the bottom wall can include a front section and a rear section and the plurality of apertures are formed exclusively in the front section of the bottom wall.

It is presently envisioned that each side wall can include at least one aperture extending from the energy dissipation chamber and through the side wall.

Preferably, the rear wall of the base unit has a width which is greater than the spacing between the laterally opposed side walls to facilitate interlocking the plurality of modular units. It is also envisioned that the rear wall of the base unit can include an upper flange which extends above the lid element.

In certain embodiments of the present disclosure, the laterally opposed side walls of the base unit each have an upper surface which is formed at an angle with respect to the bottom wall and the lid element is supported by the upper surfaces of the side walls.

Preferably, the lid includes a plurality of through holes which extend from an upper surface of the lid to the energy dissipation chamber.

In certain preferred constructions, the base unit and the lid element are formed from precast concrete and can include steel reinforcing.

It is envisioned that a stone mattress can be positioned under the plurality of module units when a stone mattress is required to inhibit erosion of the material supporting the breakwater assembly.

In certain embodiments of the disclosed breakwater assembly the plurality modular units are interlocked and arranged in a line. In some of the embodiments, the plurality of modular units are interlocked and arranged in concave formation. Alternatively, the plurality of modular units can be interlocked and arranged in convex formation. Additionally, the plurality of modular units can be arranged to contain fill or dredge spoils up to a height of the rear wall.

The present disclosure is also directed a module unit for use in a breakwater assembly that includes, inter alia, a base unit and a lid element. The base unit has a bottom wall, a rear wall, laterally opposed side walls and a front wall which in combination define an energy dissipation chamber. The lid element covers the energy dissipation chamber of the base unit and is disposed on top of the base unit at angle with respect to the bottom wall.

The present disclosure is also directed to a method of controlling coastal erosion that includes the steps of:

a. providing a breakwater assembly formed from a plurality of interconnected modular units wherein each modular unit includes: a) a base unit having a bottom wall, a rear wall, laterally opposed side walls and a front wall which in combination define an energy dissipation chamber; and b) a lid element covering the energy dissipation chamber of the base unit and disposed on top of the base unit at angle with respect to the bottom wall;
b. placing the plurality of interconnected modular units on a non-erodible native base, or non-erodible stone mattress base protecting erodible native base or erodible fill material beneath; and
c. arranging the plurality of interconnected modular units such that the lid elements are positioned on the seaward side and essentially extending from the height of the still water level at low tide to the still water level at high tide and above.

BRIEF DESCRIPTION OF THE DRAWINGS

So that those having ordinary skill in the art to which the present disclosure pertains will more readily understand how to employ the systems and methods of the present disclosure, embodiments thereof will be described in detail hereinbelow with reference to the drawings, wherein.

Figure 1A:
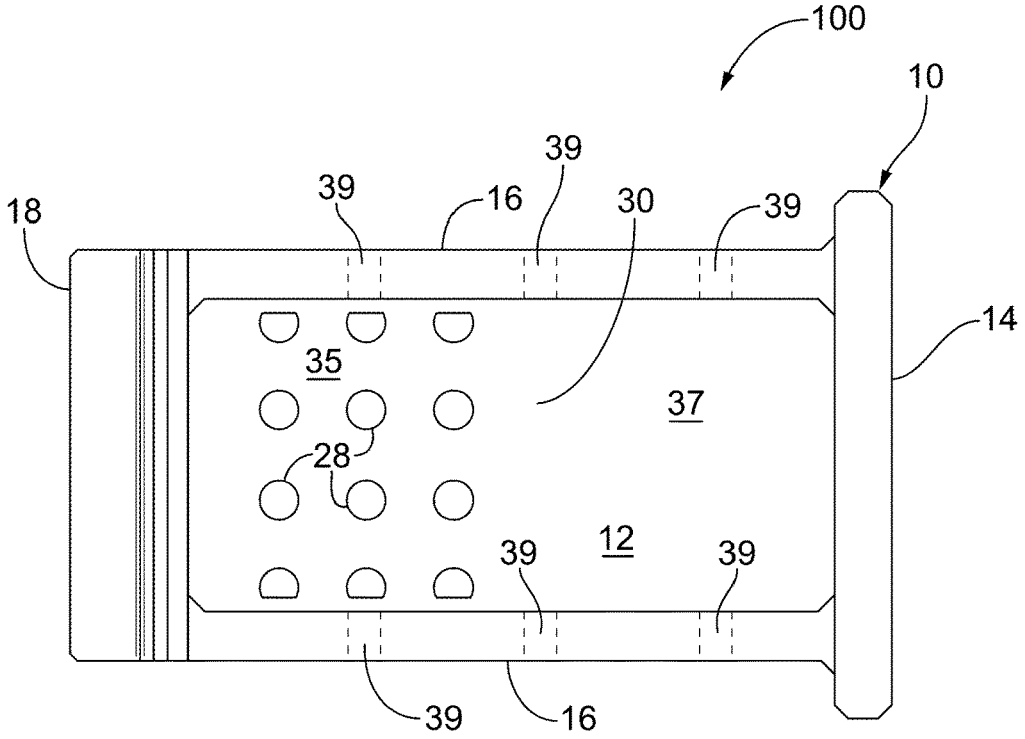
FIGS. 1A-1D respectively provide a top plan view, a bottom plan view, a side elevation view and a front elevation view of a breakwater module that has been constructed in accordance with an embodiment of the present disclosure and includes a lid element and base unit.

These and other aspects of the subject disclosure will become more readily apparent to those having ordinary skill in the art from the following detailed description of the invention taken in conjunction with the drawings.

DETAILED DESCRIPTION OF PREFERRED EMBODIMENTS

Disclosed herein are detailed descriptions of specific embodiments of the wave dissipation systems, modular units for use in wave dissipation systems and methods of constructing the same. It will be understood that the disclosed embodiments are merely examples of the way in which certain aspects of the invention can be implemented and do not represent an exhaustive list of all of the ways the invention may be embodied. Indeed, it will be understood that the systems, devices and methods described herein may be embodied in various and alternative forms. Moreover, the figures are not necessarily to scale and some features may be exaggerated or minimized to show details of particular components.

Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

The present disclosure now will be described more fully, but not all embodiments of the disclosure are necessarily shown. In addition, many modifications may be made to adapt a particular situation or material to the teachings of the disclosure without departing from the essential scope thereof.

Referring now to FIGS. 1A-1D, there is illustrated a modular unit 100 for use in a breakwater dissipation system which has been constructed in accordance with a first embodiment of the present disclosure. As will be described in detail below, modular unit 100 can be made from precast concrete and formed remotely and later placed at the beach site. Precast concrete is shown as a cost effective choice but other materials could be used. Steel boxes could be fabricated and filled with grout or other ballast. New composite materials that provide enough weight for stability could also be used. Moreover, a plurality of modular units 100 can be used to rapidly construct a breakwater system which is adaptable to a variety of beach erosion problems and can address sea-level rise conditions Modular unit 100 includes, inter alia, a base unit 10 and a lid element 50, which is shown in more detail in FIGS. 2A-2C. The base unit 10 has a bottom wall 12, a rear wall 14, laterally opposed side walls 16 and a front wall 18 which in combination define an energy dissipation chamber 30.

Figure 1B:
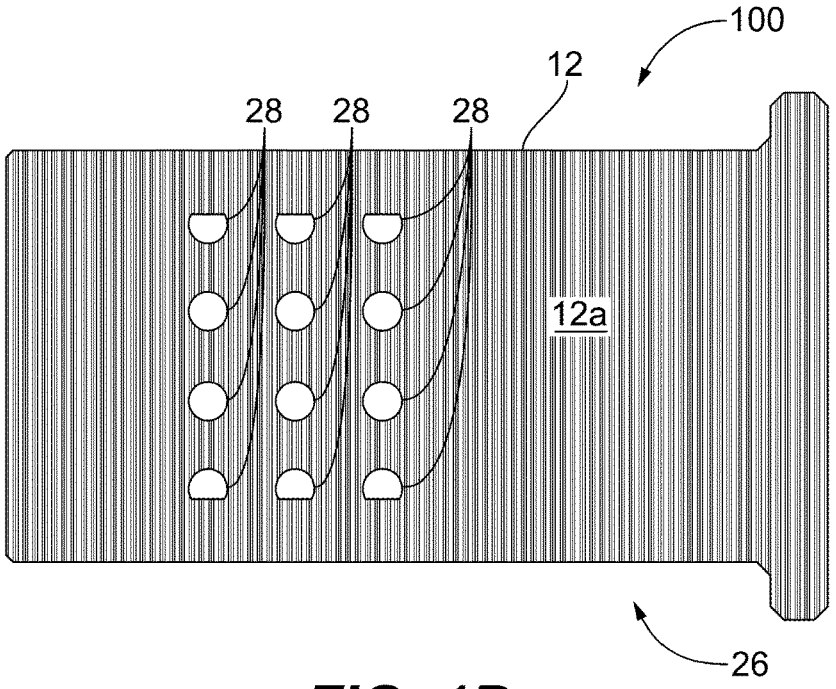
Figure 1C:
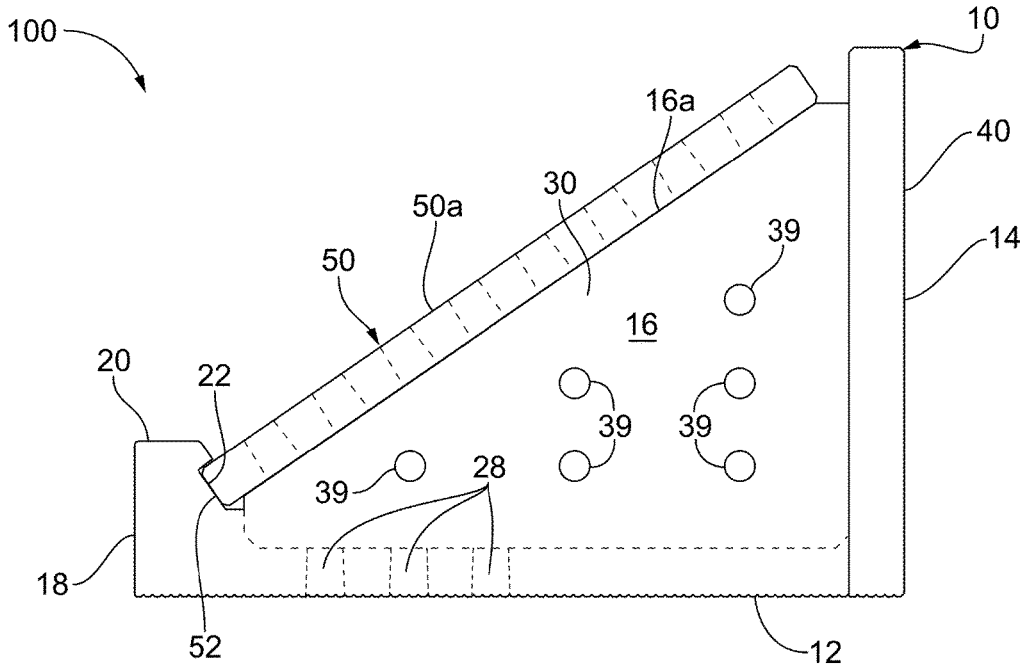
Figure 1D:
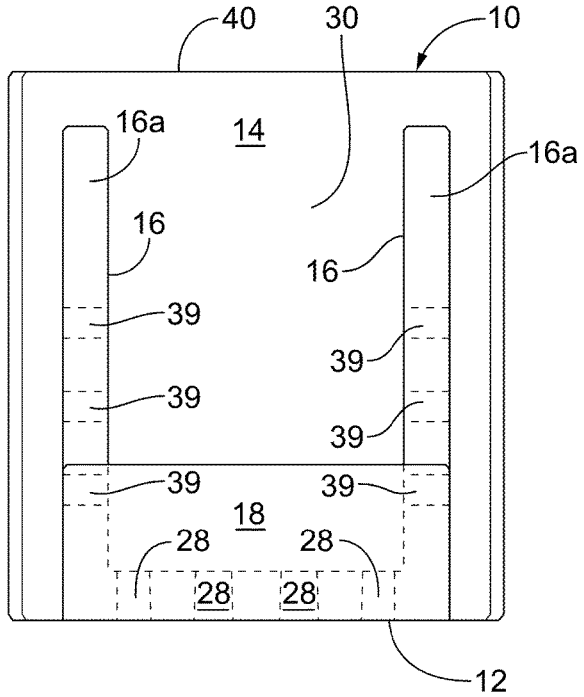

As shown in FIG. 1C, the lid element 50 covers the energy dissipation chamber 30 of the base unit 10 and is disposed on top of the base unit 10 at angle with respect to the bottom wall or base slab 12. Additionally, the front wall 18 of the base unit 10 includes a stop flange 20 for supporting a front end 52 of the lid element 50. As shown in this figure, the stop flange 20 includes a J-shaped recess 22 which receives the front end 52 of the lid element 50.

Figure 3A:
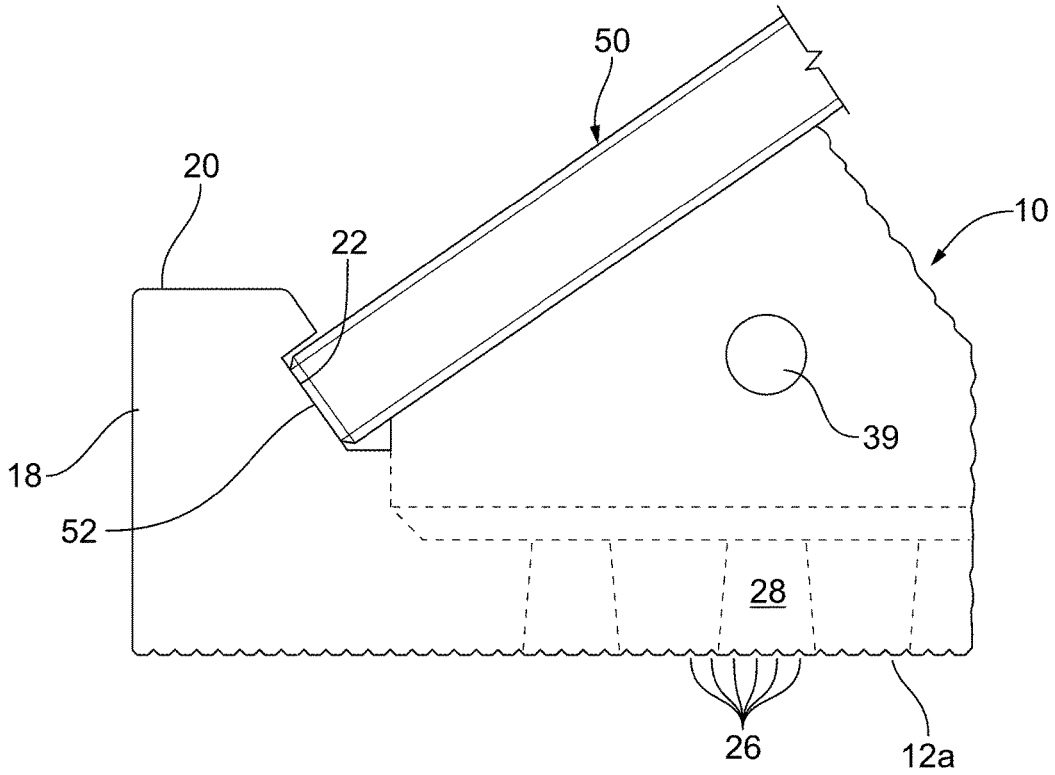
FIG. 3A is a side elevation view of a portion of the breakwater module of FIGS. 1A-1D.
Figure 3B:
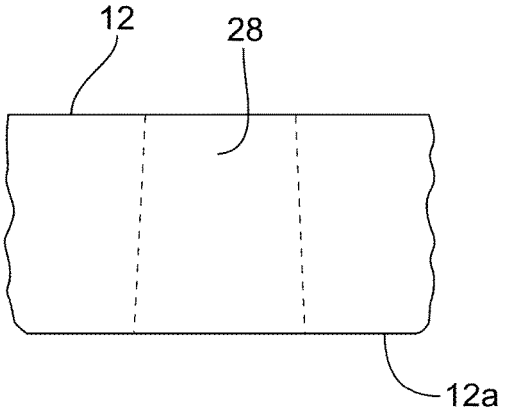
FIGS. 3B-3D provide enlarged detail views for portions of the base unit including a view of the tapered holes formed in a base unit, a detail view for the v-grooves formed in the bottom of the base unit and a detail view for a typical chamfer used on the corners of the base unit.
Figure 3C:
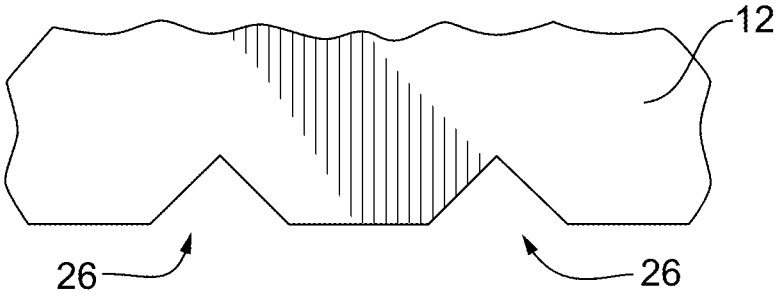
Figure 3D:
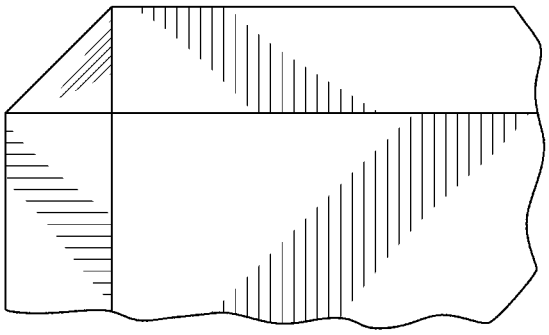

As best viewed in the bottom plan view provided in FIG. 1B and in FIGS. 3A and 3C, a plurality of laterally extending v-shaped grooves 26 are formed on a lower surface 12*a* of the bottom wall 12. These grooves 26 help prevent the modular unit from sliding due to the forces caused during wave impact. Those skilled in the art will readily appreciate that the grooves do not have to be v-shaped or formed throughout the lower surface 12*a* in order to create the desired sliding resistance. Moreover, other features and devices could be utilized alone or in combination with the grooves to improve the sliding resistance of the modular units 100.

As shown in FIGS. 1A-1D, the bottom wall or base slab 12 includes a plurality of apertures 28 which extend from the energy dissipation chamber 30 through the bottom wall 12. In the embodiment disclosed in these figures, the apertures 28 are tapered and have a larger diameter at the bottom than at the top of the aperture. As will be discussed, these apertures are used to reduce hydrostatic uplift forces. As best illustrated in FIGS. 1A and 1B, the bottom wall 12 includes a front section 35 and a rear section 37 and the plurality of apertures 28 are formed exclusively in the front section 35 of the bottom wall 12. These apertures 28 are positioned near the front section 35 because this region is potentially exposed to higher uplift pressures originating under the units. By providing a plurality of flow paths through the slab 12 in this region will allow the uplift pressure to be reduced. Typically, in the region near the rear of the unit the uplift pressure is reduced. Similar designs at other locations may have additional apertures extending farther to the rear of the bottom wall or base slab 12.

As shown in FIG. 1C, each side wall includes six apertures 39 extending from the energy dissipation chamber 30 through the side wall. The apertures 39 are used to allow the water captured within the chamber 30 to dissipate. Those skilled in the art will readily appreciate that the number, shape and size of the apertures 39 could vary depending upon the design characteristics of the modular unit.

In the top plan view provided in FIG. 1A, it is apparent that the rear wall 14 of the base unit 10 has a width "W" which is greater than distance "w" between the outside edges of the laterally opposed side walls 16 to facilitate interlocking the plurality of modular units 100.

In FIG. 1C it is shown that the laterally opposed side walls 16 of the base unit 10 each have an upper surface 16*a* which is formed at an angle with respect to the bottom wall 12 and the lid element 50 is supported by the upper surfaces 16*a* of the side walls 16. The rear wall 14 of the base unit 10 includes an upper flange 40 which extends above the lid element 30. The size of the upper flange 40 can be adjusted to preclude the anticipated amount of wave overtopping.

Figure 2A:
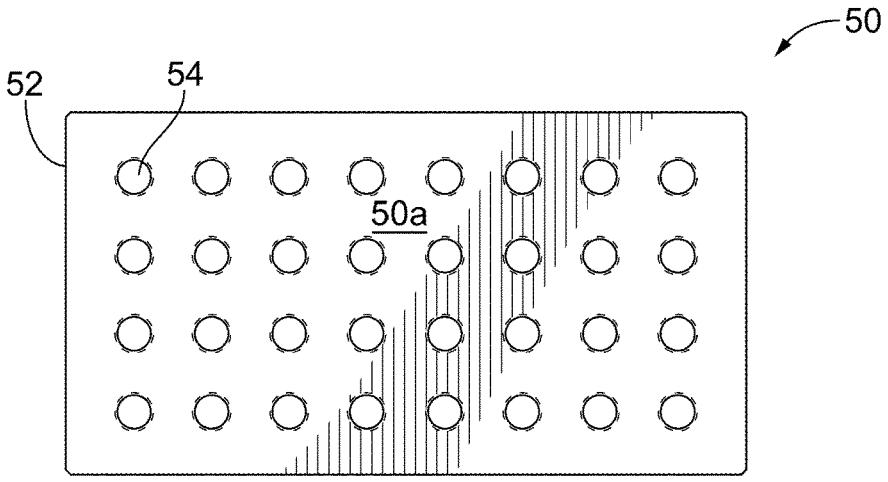
FIGS. 2A-2C respectively provide a top plan view, a side elevation view and a front elevation view of a lid element used with the breakwater module of FIGS. 1A-1D.
Figure 2B:
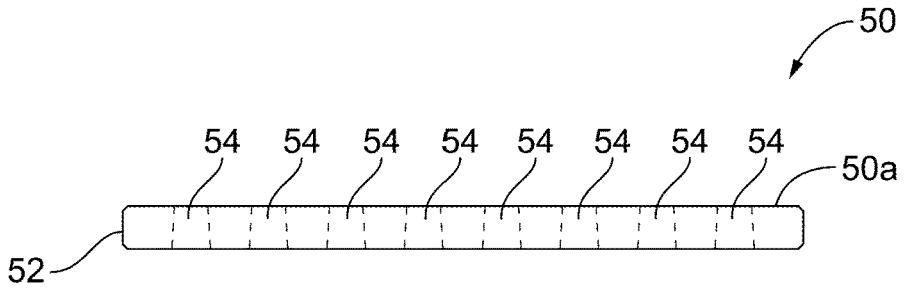
Figure 2C:
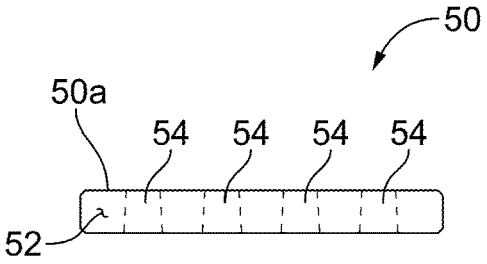

Referring now to FIGS. 2A-2C which provide a top plan view, a side elevation view and a front elevation view respectively for the lid element 50. As shown, the lid element 50 includes a plurality of through holes 54 which extend from an upper surface 50*a* of the lid to the energy dissipation chamber 30. These holes are shown as being tapered with a smaller diameter at the top than at the bottom of the hole. The tapering allows for easier fabrication and facilitates form removal. Depending on forms used and form removal sequence, the taper could be either direction. In the certain applications, the exterior aperture diameter needs to be less than 8 inches for example, to limit the size of sea creatures that could enter the aperture.

It is envisioned that the base unit and the lid element are formed from precast concrete. However, other materials can be used without departing from the inventive aspects of the present disclosure. Moreover, as shown in FIGS. 10A-10C and 11A-11C the base unit 110 and the lid element 150 can include steel reinforcing similar to that shown in these figures.

Figure 4A:
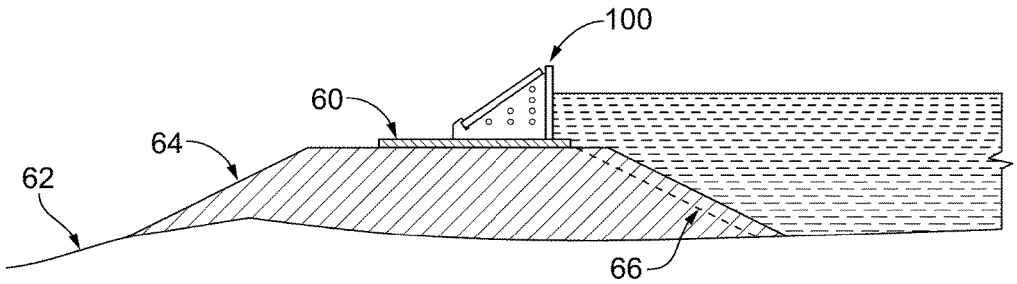
FIGS. 4A and 4B illustrate the breakwater module of FIGS. 1A-1D installed in a new beach stetting and an existing beach setting.
Figure 4B:
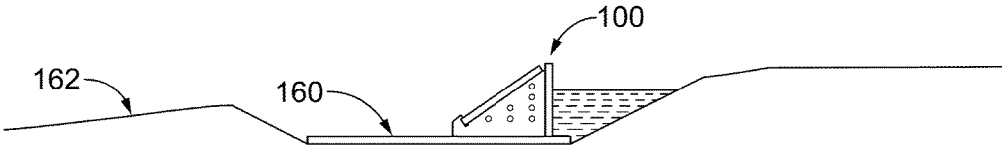

FIGS. 4A and 4B illustrate the breakwater module of FIGS. 1A-1D installed in a new beach stetting and an existing beach setting. As shown, the breakwater dissipation system can include a stone mattress 60 which supports the modules 100. In a typical new beach setting a portion of the existing grade 62 can be covered with riprap fill 64. The new mattress 60 can then be supported on the riprap fill 64 and the interlocked modular units 100 installed. Then a geotextile 66 can be laid on the back side of the fill 64 and overlaid with additional riprap. Lastly, the backside of the breakwater system can be covered with a geotextile 66 and beach fill 68 up to approximately the mid-height of the modular units 100.

In a typical existing beach setting, as shown in FIG. 4B, a portion of the existing grade 162 can be dredged to provide a lower surface for construction of the stone mattress 160 and the interlocked modular units 100.

As shown, the wave dissipation system can be constructed from a series of precast reinforced concrete structural assemblies placed atop a non-eroding stone filled mattress. The geometry, weight, and Jarlan type openings formed in the lid element dissipate energy of breaking waves and protect from wave erosion, the land behind the breakwater assembly.

As waves impact the sloping upper surface 50*a* of the lid element 50, the Jarlan type holes 54 allow water to pour into the energy dissipation chamber 30 and dissipate energy. Additional wave energy is dissipated as the wave travels up the slope and impacts the upper flange 40 of the rear wall 14. The size of the chamber 30 behind the sloping lid element 50 can be adjusted to suit a variety of field conditions. Depending on tidal elevation, some water may overtop the rear wall 14. When appropriate, erosion protection can be installed atop the material contained behind the rear wall 14.

The apertures 28 in the bottom wall 12 of the base unit 10 reduce hydrostatic uplift and the apertures 39 in the side walls 16 allow water to spill out of the chamber 30.

The modular units 100 when positioned, side by side, form a breakwater assembly. As discussed previously, the units 100 have a wide rear wall 14 that allows overlap with adjacent units. The overlapping walls function as a seawall containment feature to retain the sand and soil behind the breakwater assembly. Elevation of the land behind may vary for a variety of local conditions and minimum stability requirements.

The described breakwater system can be used at any water to land interface including ocean beaches, lake waterfronts, inland harbors, rivers, and inland waterways requiring wave dissipation and erosion protection. Moreover, the modular units of the breakwater system can be arranged to contain fill or dredge spoils up to a height of the rear wall.

Figure 5:
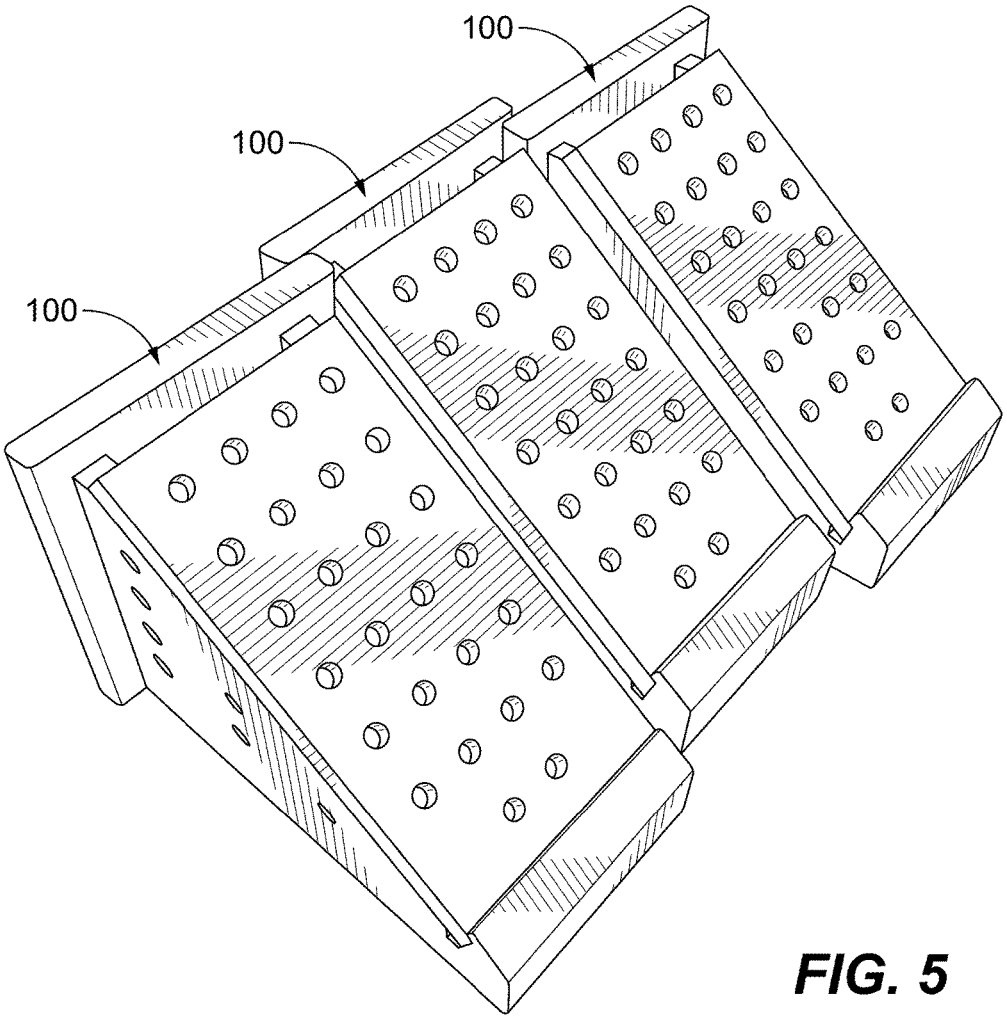
FIG. 5 provides a perspective view taken from above of a plurality of breakwater modules arranged in a straight line.
Figure 6:
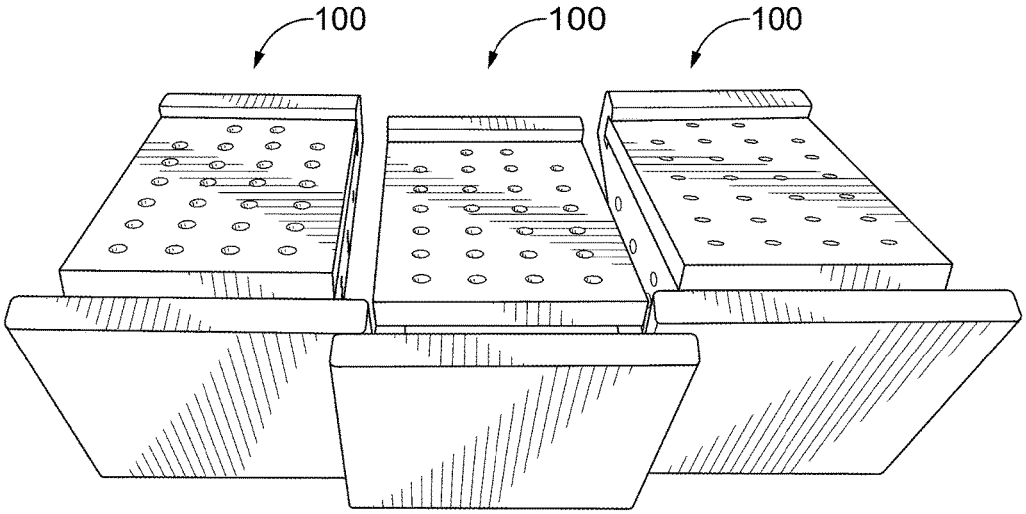
FIG. 6 provides a perspective view taken from the rear of a plurality of breakwater modules arranged in a straight line.
Figure 7:
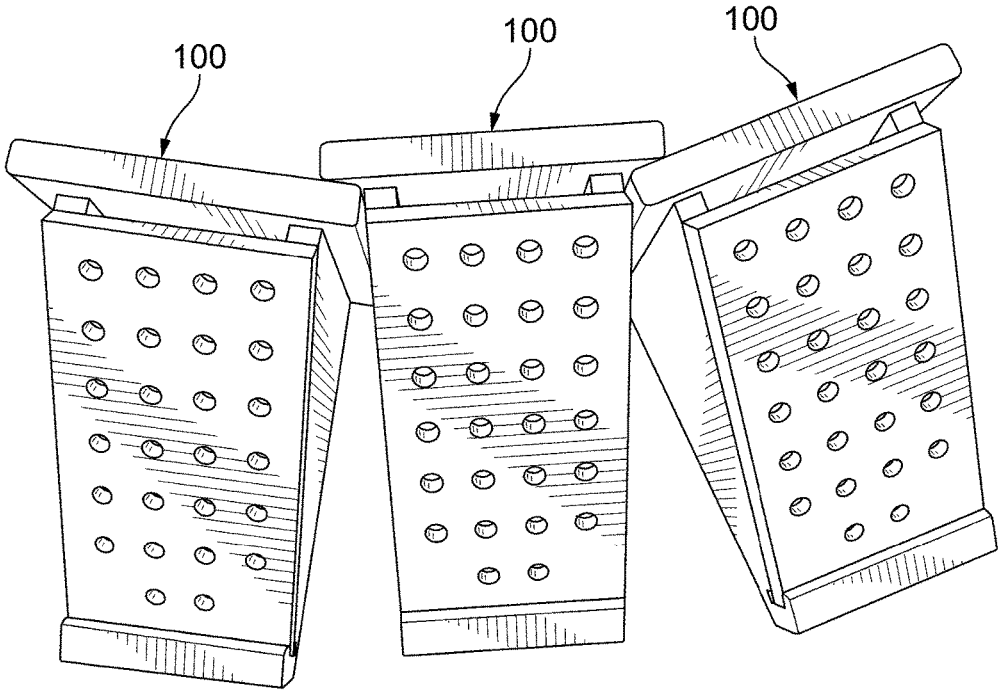
FIG. 7 provides a perspective view taken from above of a plurality of breakwater modules arranged in a concave alignment.
Figure 8:
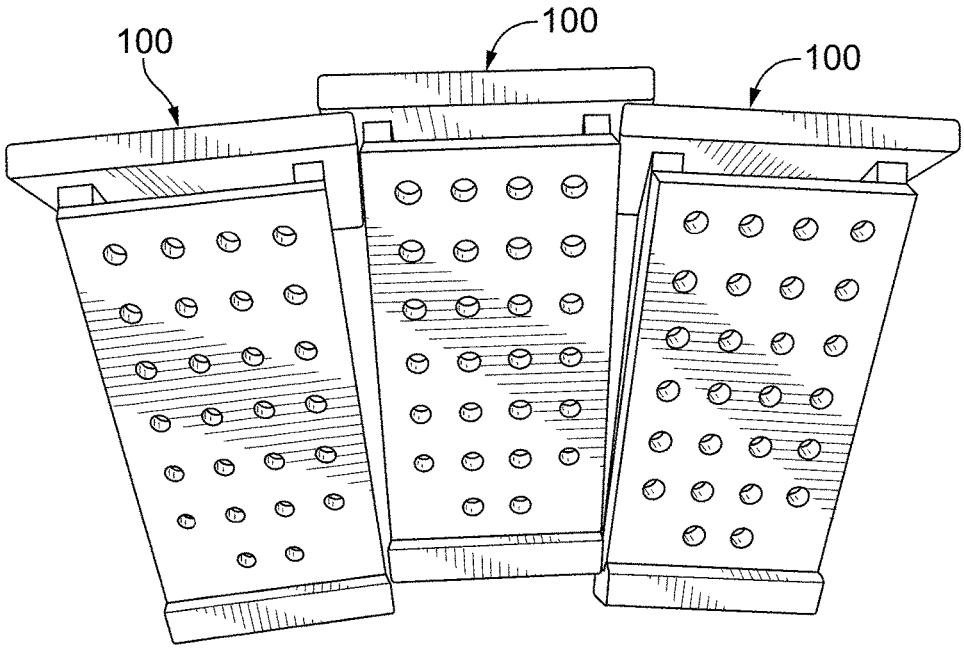
FIG. 8 provides a perspective view taken from above of a plurality of breakwater modules arranged in a convex alignment.
Figure 9:
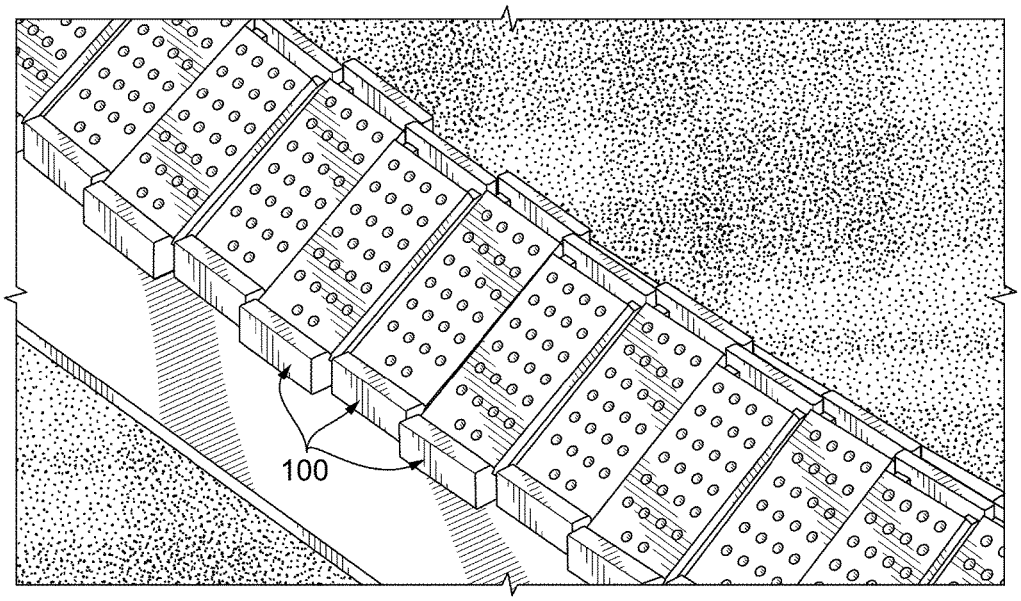
FIG. 9 provides a perspective view taken from above of a plurality of breakwater modules arranged along a slight curve and atop a stone mattress.
Figure 10A:
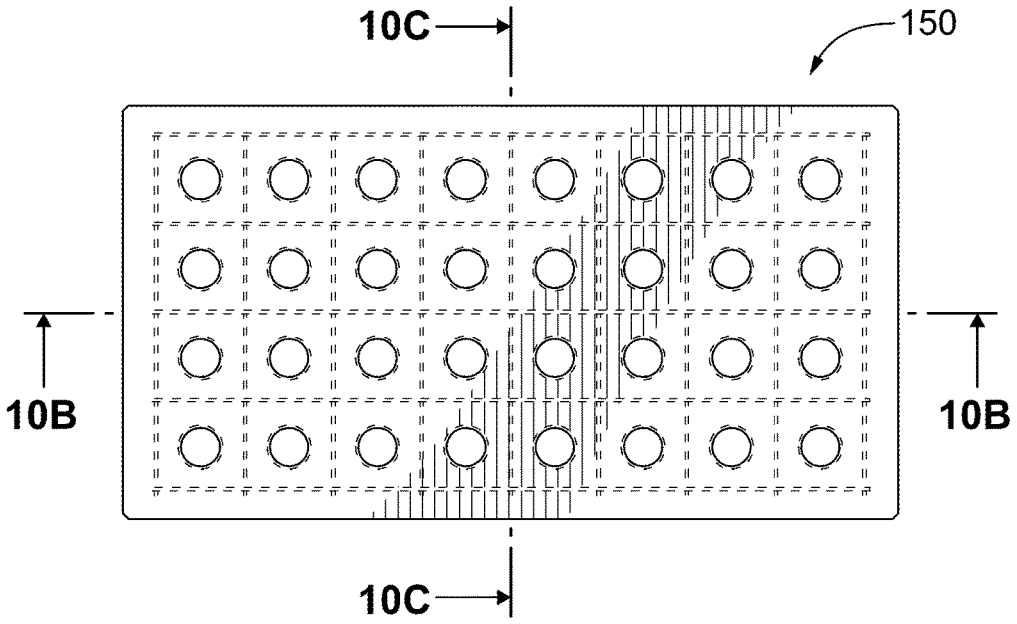
FIGS. 10A-10C provide a top plan view, side elevation view and a front elevation view respectively for a reinforced lid element which can be used with a breakwater module that has been constructed in accordance with an embodiment of the present disclosure.
Figure 10B:
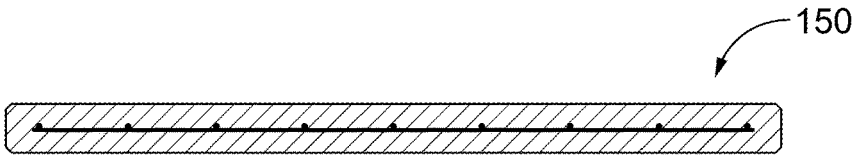
Figure 10C:
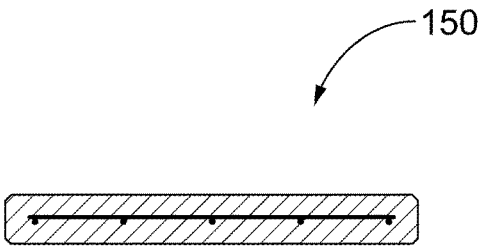
Figure 11A:
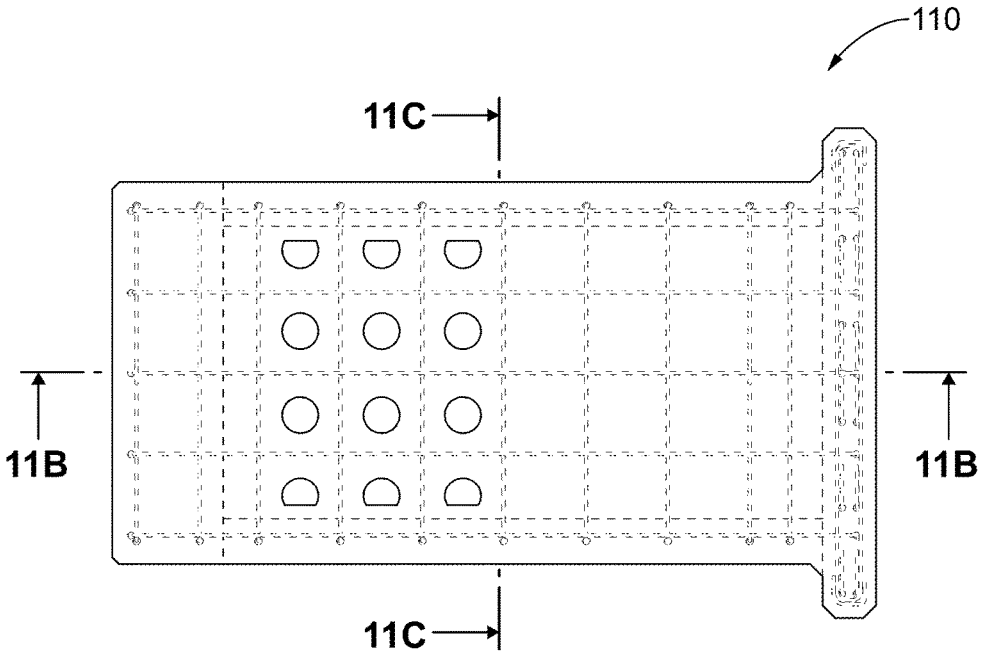
FIGS. 11A-11C provide a top plan view, side elevation view and a front elevation view respectively for a reinforced base unit which can be used with a breakwater module that has been constructed in accordance with an embodiment of the present disclosure.
Figure 11B:
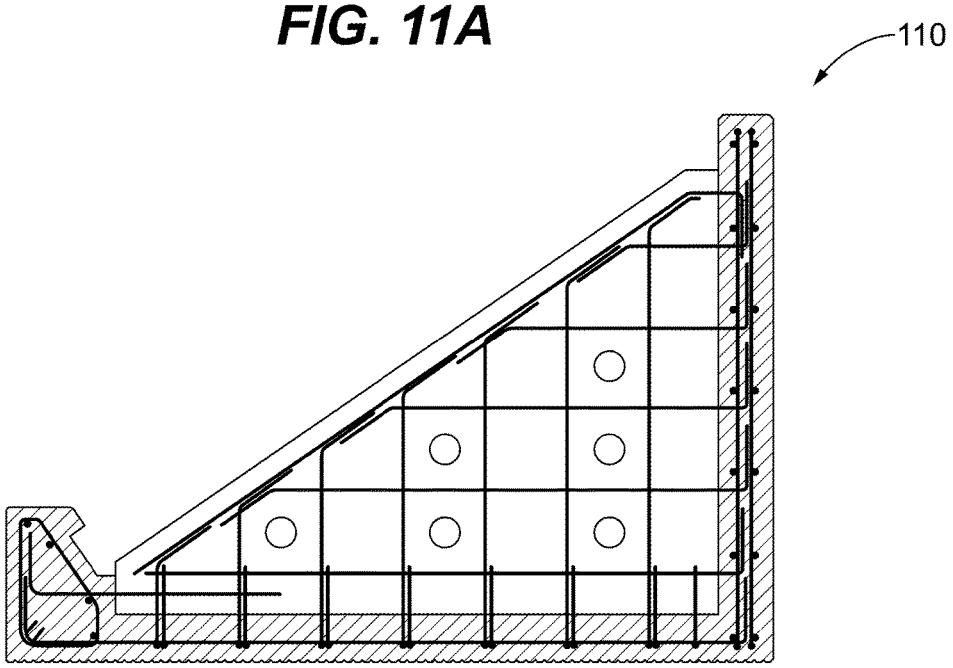
Figure 11C:
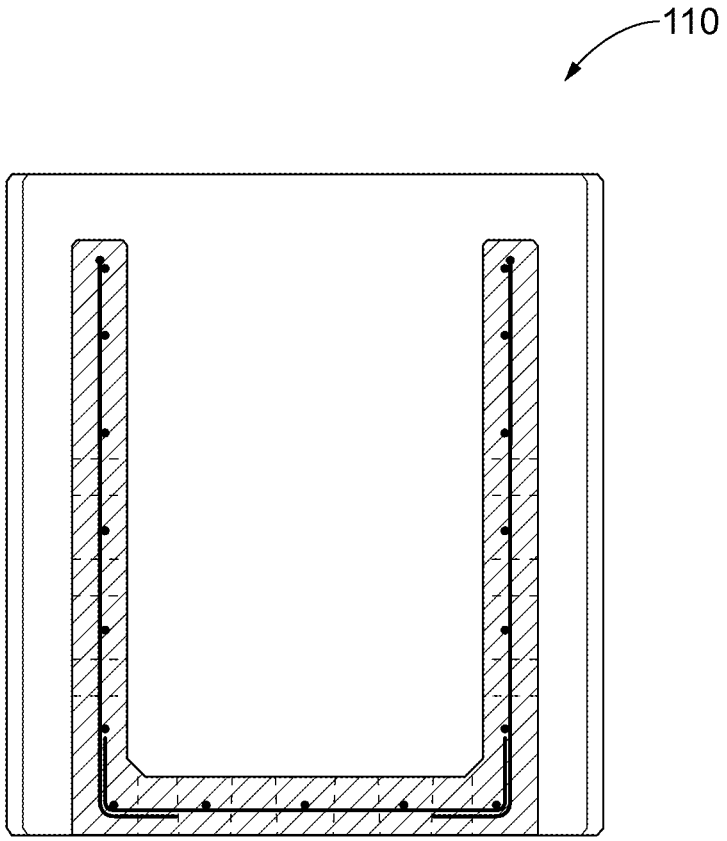

The rear wall 14 geometry allows the units to be placed in a straight line (FIGS. 5 and 6) or along a curved concave alignment at the lower front toe (FIGS. 7 and 9 (slight curve)), or along a curved convex alignment at the lower front toe (FIG. 8).

The modular units 100 can be designed with calculated factors of safely against sliding, uplift, and overturning. These factors of safety can be adjusted by varying the geometry, size, weight, and opening configuration of the units.

Calculated wave energy absorption provided by the circular holes 54 in the lid element 50 can be varied by modifying the diameter and spacing of the openings.

The height and shape of the top of the rear walls 14 can be adjusted for aesthetics or to preclude wave overtopping. Those skilled in the art will appreciate that wall height and cosmetic appearance do not alter the basic concept or performance.

The modular units 100 can be formed offsite and lifted and placed on a stone mattress and they can be removed and reused at a later time.

The precast modular units 100 can be manufactured as unreinforced or reinforced concrete, depending on the proposed application. Typically, unreinforced units will have thicker components but otherwise the basic concept or performance is not altered.

The modular units 100 can be reinforced to decrease thickness of components and to strengthen the units to avoid damage during handling. Use of stainless steel reinforcing bars should extend the useful life to well beyond 100 years. Use of un-coated steel reinforcement, galvanized reinforcement, epoxy coated reinforcement, or stainless steel reinforcement does not alter the basic concept or performance. Use of any type of reinforcement only affects the useful life of the breakwater assembly.

A typical reinforced unit could be 14 feet in length, 10 feet in height, with a rear wall width of 9 feet and such constructions can reduces reflected wave energy by more than 50%. Other units could be larger or smaller depending on local conditions at the site.

As discussed, in certain embodiments the wave dissipation system is an assembly of precast concrete modular units. The units utilize an arrangement of a Jarlan type perforated inclined lid element with a chamber behind to reduce the reflected wave energy of the impacting wave by about 50%, while maintaining adequate stability to preclude displacement resulting from wave impact. In addition, the inclined slope of the lid element 50 functions as a steep beach slope causing the momentum of the breaking wave to force the water upward, dissipating wave energy. The modular units 100 perform through a tidal range starting below mean lower low water and extending above mean higher high water. The size, geometry, opening configuration, and concrete reinforcing can be adjusted to suit a variety of beach geometries, tidal ranges, breaking wave conditions, design life, and subsequent reuse.

The disclosed wave dissipation system provides beach stability due to wave dissipation resulting from the modular units and has a long life and is reusable. The system is rapidly constructible with containment features that can be deployed and adapted to address a variety of beach erosion problems, and can also be used to address sea-level rise conditions.

The combination of precast modular units geometrically keyed together and placed atop stone mattresses, form a beach seawall containment structure with acceptable calculated sliding and overturning resistance. The modular units allow pre-fabrication offsite for later rapid installation onsite.

It is believed that the present disclosure includes many other embodiments that may not be herein described in detail, but would nonetheless be appreciated by those skilled in the art from the disclosures made. Accordingly, this disclosure should not be read as being limited only to the foregoing examples or only to the designated embodiments.

What is claimed is:

1. A breakwater assembly for controlling coastal erosion and formed from a plurality of modular units, each module unit comprising: a) a base unit having a bottom wall, a rear wall, laterally opposed side walls and a front wall which in combination define an energy dissipation chamber; and b) a lid element covering the energy dissipation chamber of the base unit and disposed on top of the base unit at angle with respect to the bottom wall;

wherein the lid includes a plurality of through holes which extend from an upper surface of the lid to the energy dissipation chamber and the side walls each include at least one aperture extending from the energy dissipation chamber through the side wall; and wherein the rear wall of the base unit has a width which is greater than a width of the front wall and is also greater than a distance between outer surfaces of the laterally opposed side walls to facilitate interlocking the plurality of modular units and such that a gap exists between the side walls of adjacent units and the front walls of adjacent units are offset and not aligned.

2. The breakwater assembly as recited in claim 1, wherein the front wall of the base unit includes a stop flange for supporting a front end of the lid element.

3. The breakwater assembly as recited in claim 2, wherein the stop flange includes a J-shaped recess which receives the front end of the lid element.

4. The breakwater assembly as recited in claim 1, wherein a plurality of laterally extending v-shaped grooves are formed on a lower surface of the bottom wall.

5. The breakwater assembly as recited in claim 1, wherein the bottom wall includes a plurality of apertures which extend from the energy dissipation chamber and through the bottom wall.

6. The breakwater assembly as recited in claim 5, wherein the apertures in the bottom wall are tapered and have a larger diameter at the bottom than at the top of the aperture.

7. The breakwater assembly as recited in claim 5, wherein the bottom wall includes a front section and a rear section and the plurality of apertures are formed exclusively in the front section of the bottom wall.

8. The breakwater assembly as recited in claim 1, wherein the laterally opposed side walls of the base unit each have an upper surface which is formed at an angle with respect to the bottom wall and the lid element is supported by the upper surfaces of the side walls.

9. The breakwater assembly as recited in claim 1, wherein the rear wall of the base unit includes an upper flange which extends above the lid element.

10. The breakwater assembly as recited in claim 1, wherein the base unit and the lid element are formed from precast concrete.

11. The breakwater assembly as recited in claim 10, wherein the base unit and the lid element include steel reinforcing.

12. The breakwater assembly as recited in claim 1, further including a stone mattress positioned under the plurality of module units when a stone mattress is required to inhibit erosion of the material supporting the breakwater assembly.

13. The breakwater assembly as recited in claim 1, wherein the plurality modular units are interlocked and arranged in a line.

14. The breakwater assembly as recited in claim 1, wherein the plurality of modular units are interlocked and arranged in concave formation.

15. The breakwater assembly as recited in claim 1, wherein the plurality of modular units are interlocked and arranged in convex formation.

16. The breakwater assembly as recited in claim 1, wherein the base and lid units are manufactured as a unitary structure.

17. The breakwater assembly as recited in claim 1, wherein the plurality of modular units are arranged to contain fill or dredge spoils up to a height of the rear wall.

18. A module unit for use in a breakwater assembly comprising:

a) a base unit having a bottom wall, a rear wall, laterally opposed side walls and a front wall which in combination define an energy dissipation chamber; and b) a lid element covering the energy dissipation chamber of the base unit and disposed on top of the base unit at angle with respect to the bottom wall, wherein the lid includes a plurality of through holes which extend from an upper surface of the lid to the energy dissipation chamber that allow water to enter the energy dissipation chamber; and wherein each side wall includes at least one aperture extending from the energy dissipation chamber and through the side wall.

19. A method of controlling coastal erosion comprising the steps of: providing a breakwater assembly formed from a plurality of interconnected modular units wherein each modular unit includes: a) a base unit having a bottom wall, a rear wall, laterally opposed side walls and a front wall which in combination define an energy dissipation chamber; and b) a lid element covering the energy dissipation chamber of the base unit and disposed on top of the base unit at angle with respect to the bottom wall, the lid including a plurality of through holes which extend from an upper surface of the lid to the energy dissipation chamber and the side walls each include at least one aperture extending from the energy dissipation chamber through the side wall; wherein the rear wall of the base unit has a width which is greater than a width of the front wall and is also greater than a distance between outer surfaces of the laterally opposed side walls to facilitate interlocking the plurality of modular units; placing the plurality of interconnected modular units on a non-erodible native base, or non-erodible stone mattress base protecting erodible native base or erodible fill material beneath; arranging the plurality of interconnected modular units such that the lid elements are positioned on the seaward side and such that the rear walls of adjacent units are interlocked and there is a gap between the side walls of adjacent unites and the front wall of adjacent units are offset.

* * * * *